US005325163A

United States Patent [19]

Nishio

[11] Patent Number: 5,325,163

[45] Date of Patent: Jun. 28, 1994

[54] CARTRIDGE TYPE DEVELOPER SUPPLIER AND DEVELOPING DEVICE FORMED AS EXCHANGEABLE UNIT

[75] Inventor: Yukio Nishio, Kurume, Japan

[73] Assignee: Fujitsu Limited, Kawasaki, Japan

[21] Appl. No.: 971,213

[22] Filed: Nov. 4, 1992

[30] Foreign Application Priority Data

Nov. 6, 1991 [JP] Japan ..... 3-289769

[51] Int. Cl.[5] ..... G03G 15/06; G03G 21/00

[52] U.S. Cl. ..... 355/260; 355/200

[58] Field of Search ..... 355/200, 210, 260; 222/DIG. 1

[56] References Cited

U.S. PATENT DOCUMENTS

| | | | |
|---|---|---|---|
| 4,914,481 | 4/1990 | Yoshikai et al. | 355/260 X |
| 5,028,961 | 7/1991 | DeCecca et al. | 355/260 |
| 5,121,165 | 6/1992 | Yoshida et al. | 355/260 |
| 5,126,799 | 6/1992 | Matsuura et al. | 355/260 X |
| 5,177,539 | 1/1993 | Tsuji | 355/260 |

FOREIGN PATENT DOCUMENTS

| | | |
|---|---|---|
| 0412923 | 2/1991 | European Pat. Off. . |
| 59-105663 | 6/1984 | Japan . |
| 59-204063 | 11/1984 | Japan . |
| 61-51177 | 3/1986 | Japan . |
| 61-116372 | 6/1986 | Japan . |
| 62-49381 | 3/1987 | Japan . |
| 63-25676 | 2/1988 | Japan . |
| 63-217385 | 9/1988 | Japan . |
| 2-165174 | 6/1990 | Japan . |

OTHER PUBLICATIONS

Patent Abstract of Japan, vol. 14, No. 426 (P-1105)(4369), Sep. 13, 1990; & JP-A-02 165 174 (Richoh) Jun. 26, 1990.

*Primary Examiner*—Fred L. Braun

*Attorney, Agent, or Firm*—Staas & Halsey

[57] ABSTRACT

A cartridge type developer supplier, detachably mounted in a developing device for an image formation apparatus such as an electrophotographic recording apparatus, includes a container for holding a developer and having an outlet port formed therein for discharging the developer therethrough, a paddle rotatably provided in the container for feeding a part of the developer from the container to the device through the port during rotation of the paddle, and a lid movably associated with the paddle so that the lid is enabled to take an initial position for closing the port when the paddle is positioned at a given angular position prior to a commencement of the rotation thereof. The lid is moved from its initial position after the commencement of the rotation of the paddle so that the port is opened to enable the container to feed developer to the device.

12 Claims, 7 Drawing Sheets

CARTRIDGE TYPE DEVELOPER SUPPLIER AND DEVELOPING DEVICE FORMED AS EXCHANGEABLE UNIT

BACKGROUND OF THE INVENTION

1) Field of the Invention

The present invention relates to a developing device with a developer supplier used in an image formation apparatus such as a copying machine, a laser printer, a facsimile or the like, wherein an electrostatic latent image is electrostatically developed with a developer.

2) Description of the Related Art

Generally, in an image formation apparatus such as an electrophotographic recording apparatus, the following processes are typically carried out:

a) a uniform distribution of electrical charges is produced on a surface of an electrostatic latent image carrying body;

b) an electrostatic latent image is formed on a charged area of the body surface by an optical writing means such as a laser beam scanner, an LED (light emitting diode) array, a liquid crystal shutter array or the like;

c) the latent image is developed as a visible image with a developer or toner, which is electrically charged to be electrostatically adhered to the latent image zone;

d) the developed and charged toner image is electrostatically transferred from the body to a recording medium such as a cut sheet paper; and e) the transferred toner image is fixed and recorded on the cut sheet paper by a toner image fixing means such as a heat roller.

Note, typically, the electrostatic latent image carrying body may be an electrophotographic photoreceptor, usually formed as a drum, called a photosensitive drum, having a cylindrical conductive substrate and a photoconductive insulating film bonded to a cylindrical surface thereof.

As one type of developer, a two-component developer is well known, which is composed of a toner component (colored fine synthetic resin particles) and a magnetic component (magnetic fine carriers). Usually, a developing device using this type of developer includes a vessel for holding the two-component developer, wherein the developer is agitated by an agitator provided therein. This agitation causes the toner particles and the magnetic carriers to be subjected to triboelectrification, whereby the toner particles are electrostatically adhered to each of the magnetic carriers. The developing device also includes a magnetic roller provided in the vessel as a developing roller in such a manner that a portion of the magnetic roller is exposed therefrom and faces the surface of the photosensitive drum. The magnetic carriers with the toner particles are magnetically adhered to the surface of the magnetic roller to form a magnetic brush therearound, and by rotating the magnetic roller carrying the magnetic brush, the toner particles are brought to the surface of the drum for the development of the electrostatic latent image formed thereon.

In this developing device, a ratio between the toner and magnetic components of the developer body held in the vessel must fall within a predetermined range before a stable development process can be continuously maintained. Accordingly, preferably, the developing device is provided with a developer supplier from which a toner component is supplied to the developer body held in the vessel, to supplement the toner component as it is consumed during the development process, whereby the component ratio of the developer body held by the vessel is kept within the predetermined range.

A one-component developer is also known, which is composed of only a toner component (colored fine synthetic resin particles), and there are two types of the one-component developer; a magnetic type and a non-magnetic type. Namely, each toner particle of the magnetic type one-component developer has a resin part and a magnetic fine powder part, whereas each particle of the non-magnetic type one-component developer has only a resin part. A developing device using the magnetic type one-component developer is also provided with a magnetic roller, which can be constructed in substantially the same manner as that for the two-component developer. Namely, the magnetic type one-component developer also can be brought to the surface of the photosensitive drum by the rotating magnetic roller as in the developing device using the two-component developer. In a developing device using the non-magnetic type one-component developer, a conductive elastic roller, which may be formed of a conductive foam rubber material, is used as a developing roller. When the conductive elastic roller is rotated within a body of the developer held by a vessel, the toner particles are frictionally entrained to be brought to the surface of the photosensitive drum. Also, the developing device using the one-component developer is preferably provided with a developer supplier from which a one-component developer is supplied to the body of developer held in the vessel, to supplement the developer as it is consumed during the development process.

As one type of developer supplier, a cartridge type is well known, which is detachably mounted in the developer vessel. This cartridge type developer supplier includes an outer cylindrical container, and an inner cylindrical container rotatably housed within the outer container and holding a given amount of the developer therein. Each of the outer and inner containers has an outlet port for discharging the developer from the developer supplier, but, before the developer supplier is mounted in the developer vessel, the outlet port of the outer container is not in register with that of the inner container so that the outlet ports are closed to prevent a leakage of the developer from the developer supplier. After the developer supplier is mounted in the developer vessel, the inner container is rotated in the outer container by manually operating a pair of lever elements provided at the end faces of the developer supplier, until the outlet ports are in register with each other, whereby it is possible to take out the developer from the developer supplier through the registered outlet ports, for supplementing the developer to the body of developer held in the vessel. Although a manner of mounting the developer supplier in the developer vessel is shown and explained in a printed matter such as a handbook, a user may frequently forget the manual operation of the lever element for taking out the developer from the developer supplier.

In one type of electrophotographic recording apparatus, in particular, a personal type of electrophotographic printer, a developing device is formed as an exchangeable unit. When the exchangeable developing device cannot be used, i.e., when a developer held therein is consumed, the developing device per se is exchanged for a new one. During shipping of the new developing devices not yet used in a printer, leakage of any developer must be prevented. Accordingly, a vessel of the exchangeable developing device is divided into two chambers by a tape-like seal element: one chamber houses a developing roller; and the other chamber holds a body of developer. Just before the new developing device is incorporated in the printer in exchange for the old developing device, the tape-like seal element is pulled and removed out of the new developing device, and thus a seal for the developer chamber is broken so that the two chambers are in communication with each other. Similar to the detachable developer supplier as mentioned above, a user may frequently forget the removal of the tape-like seal element out of the new developing device. Also, during the exchange of the old developing device for the new developing device, a leakage of developer from the new developing devices may occur because the chamber for the developing roller is in communication with the outside.

SUMMARY OF THE INVENTION

Therefore, an object of the present invention is to provide a cartridge type developer supplier detachably mounted in a developing device for an electrophotographic recording apparatus, wherein no manual operation is necessary for taking out a supplemental developer from the developer supplier.

Another object of the present invention is to provide a developing device formed as an exchangeable unit and detachably incorporated in an electrophotographic recording apparatus, wherein no manual operation is necessary for breaking a seal for a developer chamber of the developing device.

In accordance with one aspect of the present invention, there is provided a cartridge type developer supplier detachably mounted in a developing device for an electrophotographic recording apparatus, which comprises: a container means for holding a body of supplemental developer and having an outlet port formed therein for discharging the developer therethrough; a paddle means rotatably provided in the container means for feeding a part of the developer from the container means to the developing device through the outlet port during a rotation of the paddle means; and a lid means movably associated with the paddle means so that the lid means is enabled to take an initial position for closing the outlet port when the paddle means is positioned at a given angular position prior to a commencement of the rotation thereof. In this developer supplier, the lid means is moved from the initial position thereof after the commencement of the rotation of the paddle means so that the outlet port is opened to enable the container means to supply the developer to the developing device.

According to another aspect of the present invention, there is provided a cartridge type developer supplier detachably mounted in a developing device for an electrophotographic recording apparatus, which comprises: a container means for holding a body of supplemental developer and having an outlet port formed therein for discharging the developer therethrough; a paddle means rotatably provided in the container means for feeding a part of the developer from the container means to the developing device through the outlet port during a rotation of the paddle means; a lid means movably associated with the paddle means so that the lid means is enabled to take an initial position to close the outlet port when the paddle means is positioned at a given angular position prior to a commencement of the rotation thereof; a spring means for resiliently biasing the lid means so as to be moved from the initial position thereof. In this developer supplier, the paddle means is engageable with the lid means in such a manner that the lid means is forcibly moved to the initial position thereof against a resilient force of the spring means, and is disengageable from the lid means after the commencement of the rotation of the paddle means, whereby the lid means is resiliently moved from the initial position thereof so that the outlet port is opened to enable the container means to supply the developer to the developing device.

According to yet another aspect of the present invention, there is provided a developing device formed as an exchangeable unit and detachably incorporated in an electrophotographic recording apparatus, which comprises: a vessel menas; a partition wall means provided in the vessel means for dividing the vessel into first and second chambers communicating with each other through an opening formed in the partition wall; a developing roller means rotatably provided in the first chamber of the vessel means; a body of developer held in the second chamber of the vessel means; a paddle means rotatably provided in the second chamber for feeding a part of the developer from the second chamber to the first chamber through the opening of the partition means during a rotation of the paddle means; and a lid means movably associated with the paddle means so that the lid means is enabled to take an initial position to close the opening when the paddle means is positioned at a given angular position prior to a commencement of the rotation thereof. In this developing device, the lid means is moved from the initial position thereof after the commencement of the rotation of the paddle means so that the opening is opened to enable the second chamber to feed the developer to the first chamber.

BRIEF DESCRIPTION OF THE DRAWINGS

Other objects and advantages of the present invention will be better understood from the following description, with reference to the accompanying drawings, in which:

FIG. 4(*b*) is a cross-sectional view similar to FIG. 4(*a*), showing the lid member which is somewhat moved from the initial position;

FIG. 4(*c*) is a cross-sectional view similar to FIG. 4(*a*), showing the lid member which is further moved from the position shown in FIG. 4(*b*);

FIG. 5(*b*) is a cross-sectional view similar to FIG. 5(*a*), showing the lid member moved from the initial position;

FIG. 7(*b*) is a cross-sectional view similar to FIG. 7(*a*), showing the lid member moved from the initial position.

DESCRIPTION OF THE PREFERRED EMBODIMENTS

Figure 1:
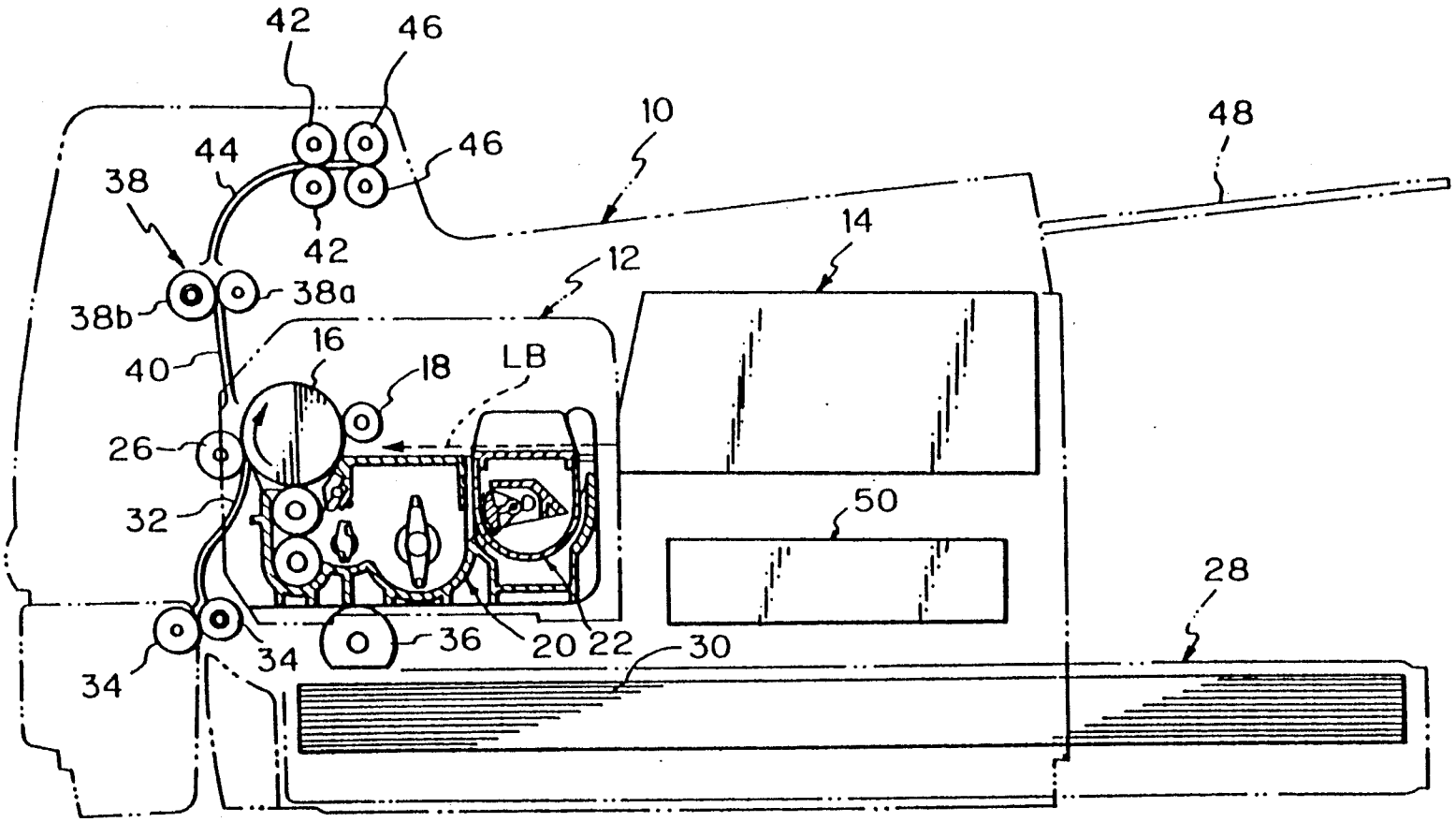
FIG. 1 is a schematic view showing an electrophotographic laser printer in which the present invention is enbodied.

FIG. 1 schematically shows a laser printer as an example of an electrophotographic recording apparatus, in which the present invention is embodied. The laser printer comprises a printer housing 10, a printing unit 12 provided in the printer housing 10, and a laser beam scanner 14 disposed adjacent to the printing unit 12. The printing unit 12 includes a rotary photosensitive drum 16 as a latent image carrying body, which is rotated in a direction indicated by an arrow in FIG. 1 during an operation of the printer. For example, the drum 16 may be formed of an aluminum cylindrical hollow body and a photoconductive film composed of an organic photoconductor (OPC) and bonded to a surface of the hollow body.

The printing unit 12 also includes an electrical charging roller 18 which is resiliently pressed against the photosensitive drum 16 to produce a charged area on the drum 16. The charging roller 18 is formed as a conducive foam rubber roller, which is preferably made of a conductive polyurethane foam rubber material having, for example, a plurality of pore openings or cells having an average diameter of about 10 μm, a density of 200 cells/inch, an Asker hardness of 23 degs, and a resistivity of about $10^7$ Ω cm. The charging roller 18 is subjected to an application of an electric energy so that a charged area having, for example, a potential of about −600 volts is produced on the surface of the drum 16. Alternatively, an electric discharger such as a corona discharger may be used in place of the charging roller 18.

The laser beam scanner 14 writes an electrostatic latent image on the charged area of the drum 16, and includes a laser source such as a semiconductor laser diode for emitting a laser light, an optical system for focusing the laser light into a laser beam LB, and an optical scanning system such as a polygon mirror for deflecting the laser beam LB along a direction of a central axis of the drum 16 so that the charged area of the drum 16 is scanned by the deflecting laser beam LB. During the scanning, the laser beam LB is switched on and off on the basis of binary image data obtained from, for example, a word processor, personal computer or the like, so that an electrostatic latent image is written as a dot image on the charged area of the drum 16. In particular, when a zone of the charged area is irradiated by the laser beam LB, the charges are released from the irradiated zone so that a potential thereof is changed from about −600 volts to about −100 volts, whereby the latent image is formed as a potential difference between the irradiated zone and the remaining zone.

Figure 2:
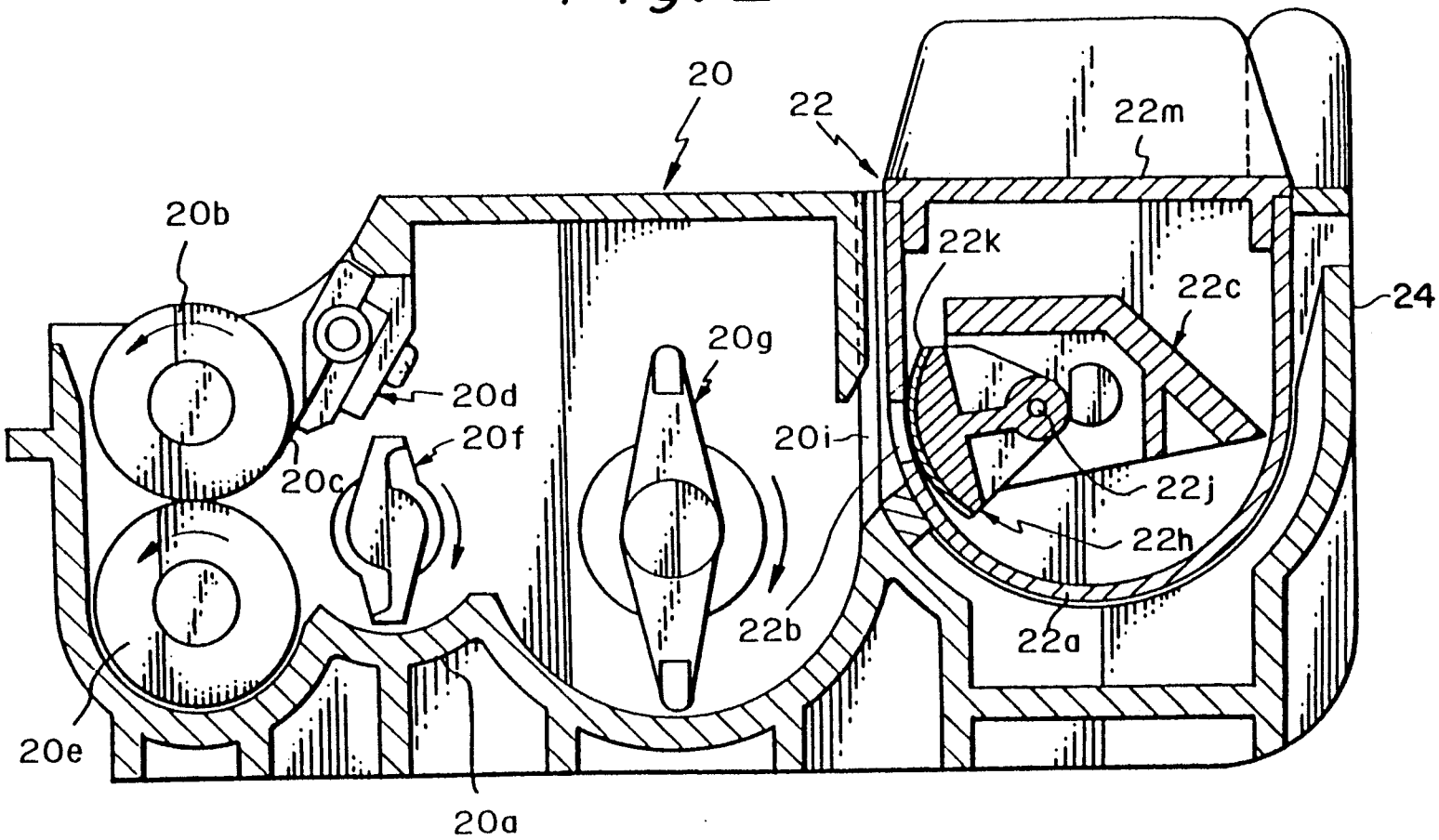
FIG. 2 is an enlarged view showing a developing device of the electrophotographic laser printer shown in FIG. 1.

The printing unit 12 further includes a toner developing device 20, which is best shown in FIG. 2, including a vessel 20*a* for holding a non-magnetic type one-component developer composed of a toner component (colored fine resin particles), and a developing roller 20*b* provided within the vessel 20*a* in such a manner that a portion of the developing roller 20*b* is exposed therefrom and pressed against the surface of the photosensitive drum 16. The developing roller 20*b* is also formed as a conductive foam rubber roller, which is preferably made of a conductive polyurethane foam rubber material having, for example, a plurality of pore openings or cells having an average diameter of about 10 μm, a density of 200 cells/inch, an Asker hardness of 23 degs, and a resistivity of about from $10^4$ to about $10^7$ Ω cm. The developing roller 20*b* is rotated in a direction indicated by an arrow in FIG. 2, and frictionally entrains the toner particles to form a developer or toner layer therearound, whereby the toner particles are brought to the surface of the drum 16 for a development of the latent image formed thereon. Note, the developing roller 20*b* formed of the polyurethane foam rubber material has an excellent property for entraining the toner particles.

The developing device 20 also includes a blade member 20*c* supported by the vessel 20*a* through attachment fittings, generally indicated by reference 20*d*, such that the blade member 20*c* is engaged with a surface of the developing roller 20*b* to make a thickness of the toner layer formed therearound uniform, whereby an even development of the latent image can be ensured. The blade member 20*c* is formed of a conductive material such as metal, and is subjected to an application of a voltage so that the toner particles are negatively charged by a charge-injection effect. During the developing process, the developing roller 20*b* is subjected to a developing bias voltage of −300 volts, the negative charged toner particles are electrostatically adhered to only the latent image zone having the potential of about −100 volts, because the latent image zone is charged with the negative particles.

The developing device 20 further includes a toner-removing roller 20*e* rotatably provided within the vessel 20*a* and resiliently pressed against the developing roller 20*b*. The toner-removing roller 20*e* is rotated in the same direction as the developing roller 20*b*, as indicated by an arrow in FIG. 2, so that the surfaces of the rollers 20*b* and 20*e* are rubbed against each other in reverse directions at the contact zone therebetween, whereby residual toner particles not used for the development of the latent image are mechanically removed from the developing roller 20*b*. On the other hand, the toner-removing roller 20*e* serves to feed the toner particles to the developing roller at one side of the nip therebetween (i.e., the right side in FIG. 2), because the toner particles entrained by the toner-removing roller 20*e* are moved toward the nip between the rollers 20*b* and 20*e*. The toner-removing roller 20*e* is formed as a conductive foam rubber roller, which is preferably made of a conductive polyurethane foam rubber material having, for example, a density of 40 cells/inch, and a resistivity of about from $10^4$ Ω cm. The toner-removing roller 20*e* is subjected to an application of a voltage to thereby be negatively charged, so that a penetration of the toner particles thereinto can be prevented.

Furthermore, the developing device 10 includes a paddle roller 20*f* and an agitator 20*g* provided in the vessel 20*a* and rotated indirections indicated by arrows in FIG. 2, respectively. The paddle roller 20*f* serves to move the toner particles toward the toner-removing roller 20e, and the agitator 20g agitates the body of the toner to eliminate a dead stock thereof from the vessel 20a.

The vessel 20a is provided with a cartridge type developer supplier 22 detachably mounted in a receiver 24 which is integrally formed with the vessel 20a. The developer supplier 22 includes a container 22a having an outlet port 22b formed therein for discharging a supplemental developer held therein. When the developer supplier 22 is mounted in the receiver 24 and is positioned in place, the outlet port 22b is in register with an opening 20i formed in a wall portion disposed between the vessel 20a and the receiver 24, whereby the supplemental developer can be fed from the container 22a to the vessel 20a through the opening 20i and the outlet port 22b, if necessary. The details of the developer supplier 22 constructed according to the present invention will be explained hereinafter.

The printing unit 12 includes a conductive roller type transfer charger 26 for electrostatically transferring the developed toner image from the photosensitive drum 16 to a recording medium such as a cut sheet paper. The transfer charger 26 is formed as a conductive foam rubber roller, which is preferably made of a conductive polyurethane foam rubber material having, for example, a plurality of pore openings or cells having an average diameter of about 10 μm, a density of 200 cells/inch, an Asker hardness of 23 degs, and a resistivity of about $10^7$ Ω cm. Namely, the material of the transfer roller 26 may be identical to that of the charging roller 18. The transfer roller 26 is resiliently pressed against the drum 16, and is subjected to an application of an electric energy so that positive charges are supplied to the paper, whereby the negatively-charged toner image can be electrostatically attracted to the paper.

The printer further comprises a paper cassette 28 in which a stack of cut sheet paper 30 is received, and a paper guide 32 extended from the paper cassette 28 toward a nip between the photosensitive drum 16 and the transfer roller 26, and a pair of register rollers 34, 34 incorporated in the paper guide 32. During the printing operation, papers to be printed are fed one by one from the stack of cut sheet paper 30 into the paper guide 32 by driving a paper feeding roller 36 incorporated in the paper cassette 28. The fed paper is stopped once at the register roller 34, 34, and is then introduced into the nip between the drum 16 and the transfer roller 26 at a given timing, so that the developed toner image can be transferred to the paper in place. The paper discharged from the nip between the drum 16 and the transfer roller 26, i.e., the paper carrying the transferred toner image is then moved toward a toner image fixing device 38 along a paper guide 40 extended between the transfer roller 26 and the fixing device 38, and is passed through a nip between a heat roller 38a and a backup roller 38b of the fixing device 38, whereby the transferred toner image is thermally fused and fixed on the paper.

The paper carrying the fixed toner image is moved toward a pair of guide rollers 42, 42 along a paper guide 44 extended between the fixing device 38 and the guide rollers 42, 42, and is then discharged from a pair of paper-discharging rollers 46, 46 adjacent to the guide rollers 42, 42 to a paper tray 48 provided on the printer housing 10. Note, in FIG. 1, reference numeral 50 indicates a controller, illustrated as a block, for the printer.

Figure 3:
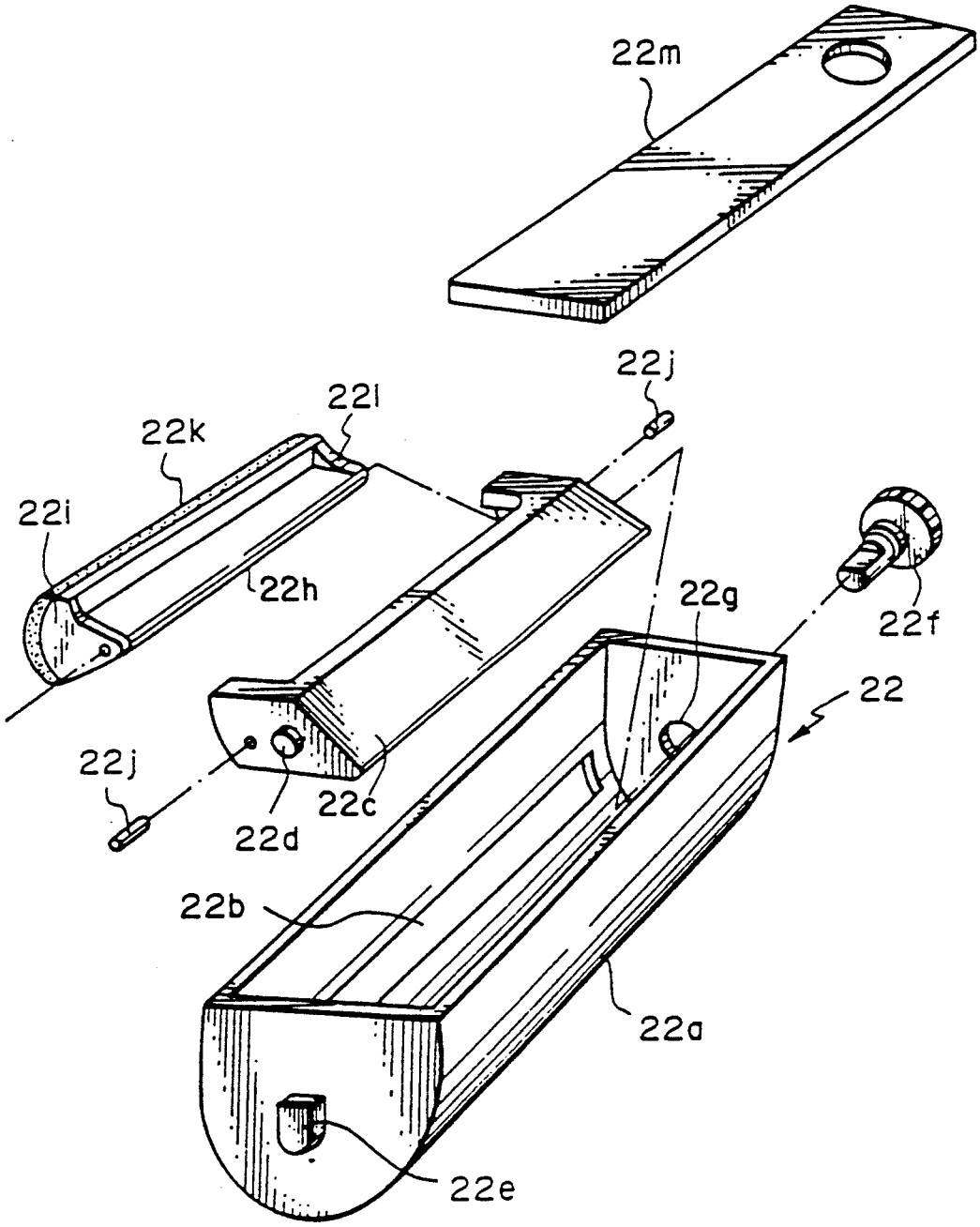
FIG. 3 is an exploded perspective view showing a cartridge type developer supplier detachably mounted in the developing device of FIG. 2.

As best shown in FIG. 3, the developer supplier 22 includes a paddle blade member 22c rotatably provided in the container 22a. In particular, the paddle blade member 22c has a stub element 22d projected from one end face thereof, and a generally semicircle-shaped hole (not visible in FIG. 3) formed at the other end face thereof. The stub element 22d is rotatably supported by a bearing 22e provided at the corresponding end wall of the container 22a, and the semicircle-shaped hole of the paddle blade member 22c receives a shaft of a gear 22f having a generally semicircle-shaped cross section and rotatably inserted into a circular hole 22g formed in the corresponding end wall of the container 22a, whereby the paddle blade member 22c is rotatable in the container 22a.

Figure 4A:
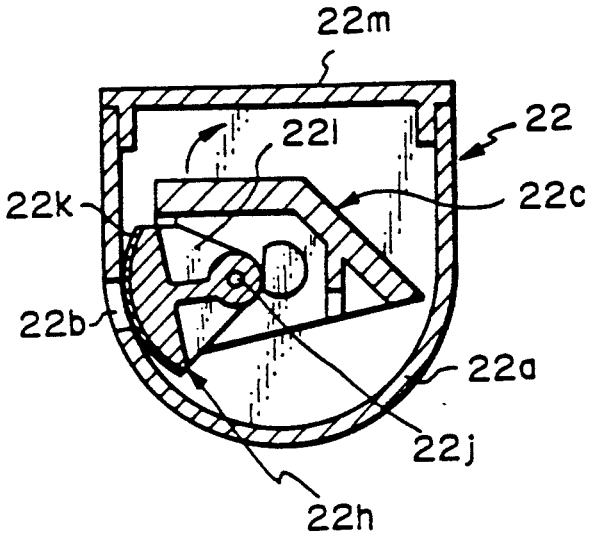
FIG. 4(*a*) is a cross-sectional view of the cartridge type developer supplier of FIG. 3, showing a lid member of the developer supplier at an initial position.

The developer supplier 22 also includes a lid member 22h swingably supported by the paddle blade member 22c. In particular, the lid member 22h has a pair of generally sector-shaped end plate elements 22i, 22i pivoted at the end faces of the paddle blade member 22c by a pair of pivot pin elements 22j, 22j, as shown in FIG. 3, whereby the lid member 22h can be swung with respect to the paddle blade member 22c. The lid member 22h is provided with an elastic seal element 22k securely attached thereto, which may be made of a sponge material. When the supplemental developer is received in the container 22a, the paddle blade member 22c is positioned at an angular position as shown in FIG. 4(a), so that the lid member 22h can function to close the outlet port 22b with the elastic seal element 22k thereof, whereby a prevention of leakage of the supplemental developer from the outlet port 22b can be ensured. When the lid member 22h is positioned as shown in FIG. 4(a), the elastic seal element 22k is pressed against an inner wall surface zone of the container 22a, by which the outlet port 22b is surrounded, to be resiliently deformed, whereby the lid member 22h can be resiliently kept at the closed position shown in FIG. 4(a). After the container 22a is filled with the supplemental developer up to a given level, the container 22a is closed by a cover member 22m.

Figure 4B:
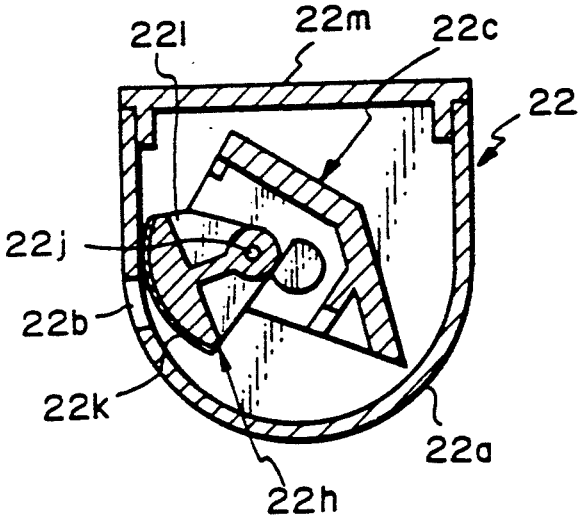
Figure 4C:
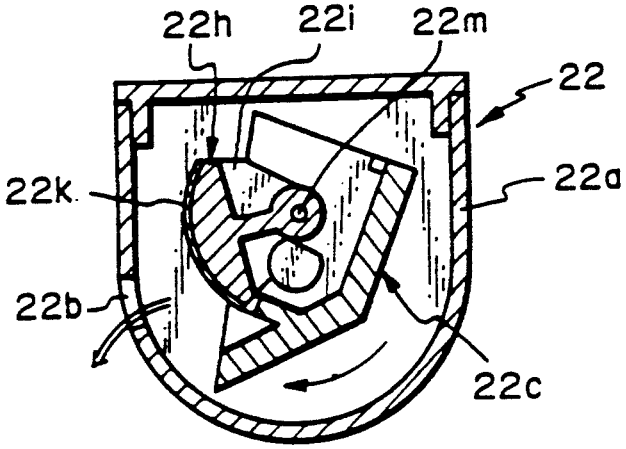

When the developer supplier 22 is mounted in the receiver 24, as shown in FIG. 2, the gear 22f is engaged with an output gear of a gear train (not shown), for example, supported by a frame of the printer. When a rotational drive force is transmitted to the gear 22f through the gear train so that the paddle blade member 22c is rotated in a direction indicated by an arrow in FIG. 4(a), the lid member 22h is entrained by the rotating paddle blade member 22c, and is rotationally moved about the pivot pins 22j in the reverse direction, as shown in FIG. 4(b) . Namely, the lid member 22h is moved from the closed position shown in FIGS. 2 and 4(a), and thus the output port 22b is opened for discharging the supplemental developer. When the paddle blade member 22c is further rotated in a direction indicated by a solid arrow in FIG. 4(c), the lid member 22h is abutted against the paddle blade member 22c at one side edge thereof, and is encompassed by a surface of revolution described by the rotating paddle blade member 22c. At the same time, a part of the supplemental developer is discharged from the container 22a through the opened outlet port 22b thereof due to a paddling action of the paddle blade member 22c, as indicated by a hollow arrow in FIG. 4(c) , whereby the developer can be supplemented or fed from the container 22a to the vessel 20a. Note, the lid member 22h cannot interfere in the discharging of the supplemental developer through the outlet port 22b because the lid member 22h is encompassed in the surface of revolution defined by the paddle blade member 22c, as mentioned above.

The supplement or feed of the developer is carried out in accordance with a consumption of the developer held by the vessel 20a. In particular, during the operation of the developing device 20, an amount of the developer held by the vessel 20a is detected by a suitable developer sensor (not shown). When the developer sensor indicates that the amount of the developer is reduced to less than a predetermined level, the rotation of the paddle blade member 22c is carried out for the supplement of the developer from the container 22a to the vessel 20a. After a given amount of the supplemental developer is fed from the container 22a to the vessel 20a, the rotation of the paddle blade member 22c is stopped.

Figure 5A:
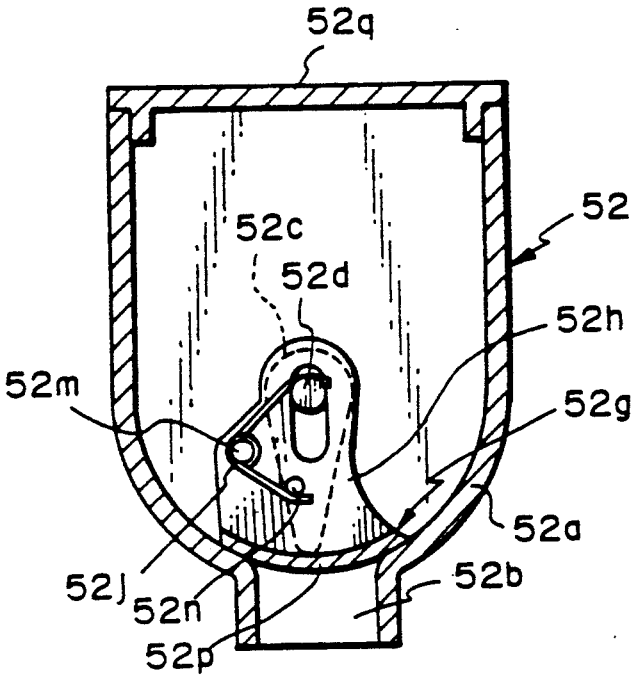
FIG. 5(*a*) is a cross-sectional view of another cartridge type developer supplier according to the present invention, showing a lid member of the developer supplier at an initial position.
Figure 5B:
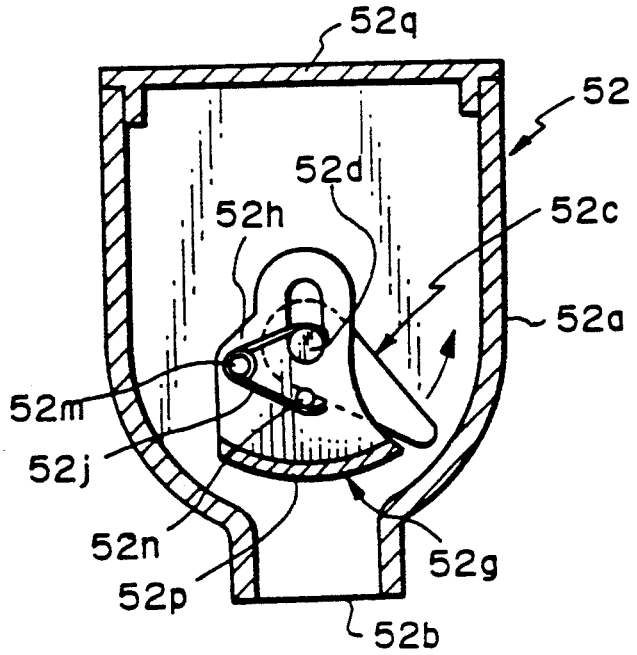

FIGS. 5(*a*), 5(*b*), and 6 show another embodiment of another cartridge type developer supplier 52 according to the present invention, which is detachably mounted in another type different from the developing device 20 shown in FIGS. 1 and 2. The developer supplier 52 includes a container 52a having an outlet port 52b formed at a bottom thereof for discharging a supplemental developer held therein, as shown in FIGS. 5(*a*), and 5(*b*). When the developer supplier 52 is mounted in place in the developing device, the outlet port 52b is in register with an opening formed in a developer vessel of the developing device, for supplementing the developer from the container 52 to the developer vessel.

Figure 6:
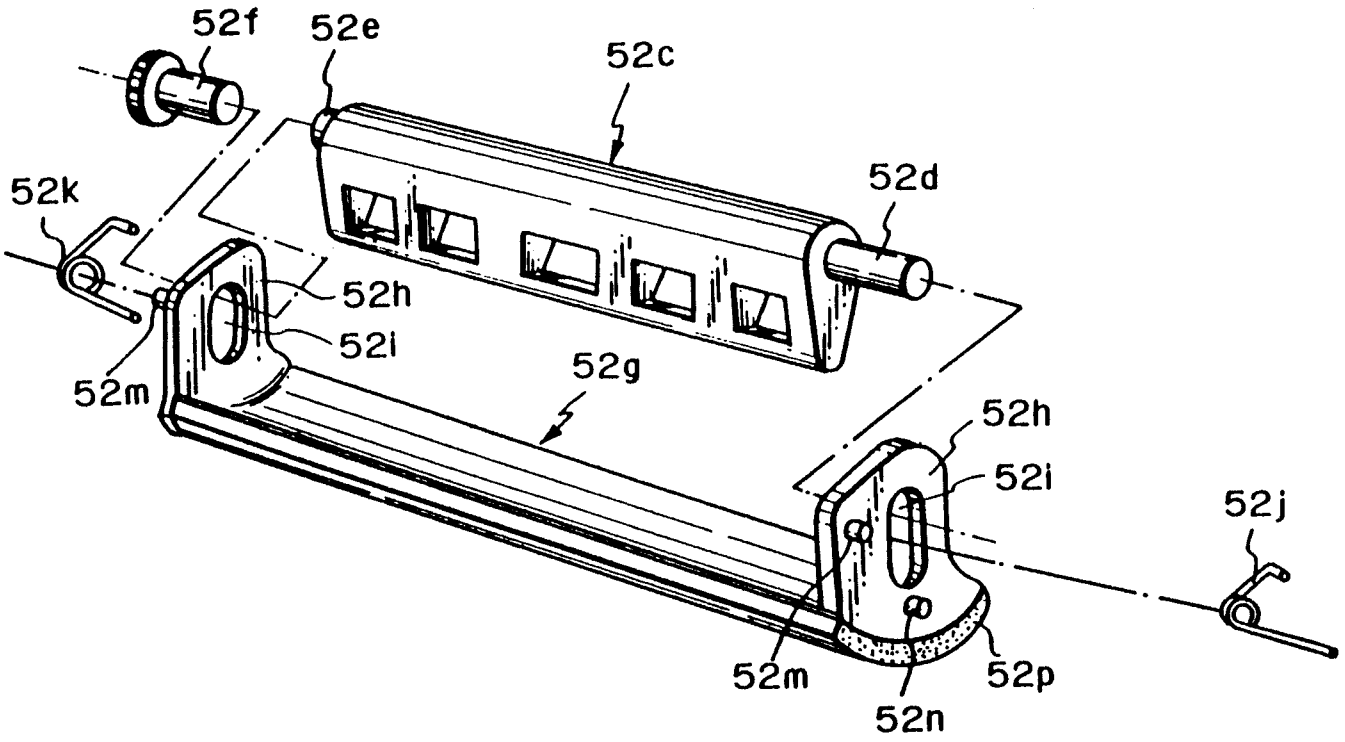
FIG. 6 is an exploded perspective view showing main parts of the cartridge type developer supplier shown in FIGS. 5(*a*) and 5(*b*)

As best shown in FIG. 6, the developer supplier 52 includes a paddle blade member 52c rotatably provided in the container 52a. In particular, the paddle blade member 52c has a stub element 52d projected from one end face thereof, and a sleeve element 52e formed at the other end face thereof. The stub element 52d is rotatably supported by an end wall of the container 52a, and the sleeve element 52e is fixedly connected to a shaft of a gear 52f rotatably supported by the other end wall of the container 52a, whereby the paddle blade member 52c is rotatable in the container 52a.

The developer supplier 52 also includes a lid member 52g movably attached to the paddle blade member 52c. In particular, the lid member 52g is provided with a pair of end plate elements 52h, 52h each having an elongated slot 52i formed therein. The lid member 52g is assembled to the paddle blade member 52c in such a manner that the stub element 52e and the gear shaft (52f) pass through the elongated slots 52i, 52i of the end plate elements 52h, 52h, respectively, whereby the lid member 52g is movable with respect to the paddle blade member 52c along a length of the elongated slots 52i, 52i.

The lid member 52g is resiliently biased toward a rotational axis of the paddle blade member 52c by first and second torsion springs 52j and 52k provided therebetween. In particular, each of the end plate elements 52h, 52h has two projections 52m and 52n protruded from an outer face thereof. The first torsion spring 52j is mounted on the projection 52m in such a manner that two spring arms thereof are engaged with the stub element 52d and the projection 52n, respectively, and the second torsion spring 52k is associated with the gear shaft (52f) and the projections 52m and 52n in substantially the same manner as the first torsion spring 52j.

The lid member 52g is provided with an elastic seal element 52p securely attached thereto, which may be made of a sponge material. When the supplemental developer is received in the container 52a, the paddle blade member 52c is positioned in such a manner that a free end edge thereof is abutted against an inner face of the lid member 52g against a resilient force of the first and second torsion springs 52j and 52k, as shown in FIG. 5(*a*), so that the lid member 52g can close the outlet port 22b with the elastic seal element 52p thereof, whereby prevention of leakage of the supplemental developer from the outlet port 52b can be ensured. After the container 52a is filled with the supplemental developer up to a given level, the container 52a is closed by a cover member 52q.

Similar to the developer supplier 22, when the developer supplier 52 is mounted in the developing device, the gear 52f is engaged with an output gear of a gear train (not shown). When a rotational drive force is transmitted to the gear 52f through the gear train so that the paddle blade member 52c is rotated in a direction indicated by an arrow in FIG. 5(*b*), the paddle blade member 52c is disengaged from the inner face of the lid member 52g, and thus the lid member 52g is lifted by the resilient force of the first and second torsion springs 52j and 52k, to thereby open the outlet port 52b for discharging the supplemental developer. In this embodiment, the lid member 52g also is encompassed by a surface of revolution described by the rotating paddle blade member 52c.

According to the above-mentioned embodiments, no manual operation is necessary for taking out the supplemental developer from the developer supplier for supplementing the developer to the developer vessel of the developing device. Namely, only a setting by a user of the developer supplier is necessary before a proper operation of the developing device can be obtained.

Figure 7A:
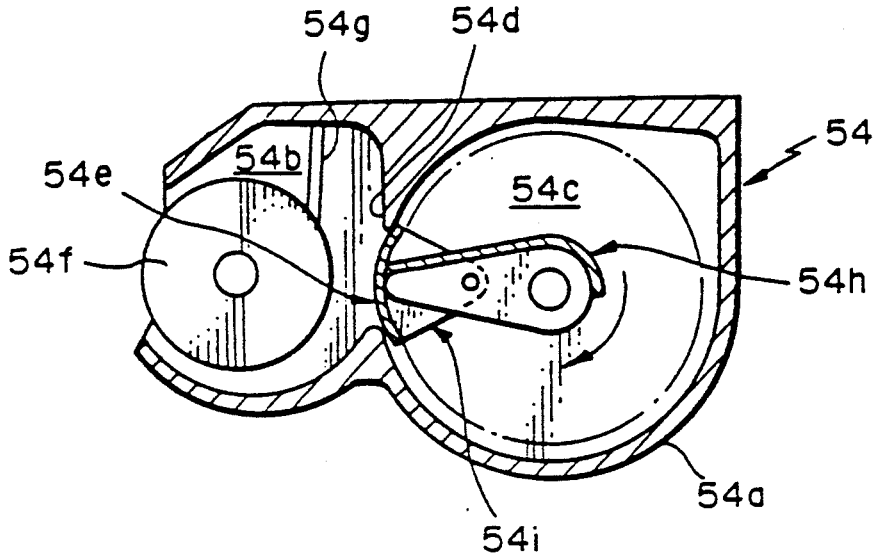
FIG. 7(*a*) is a cross-sectional view of another developing device according to the present invention, showing a lid member of the developing device at an initial position.
Figure 7B:
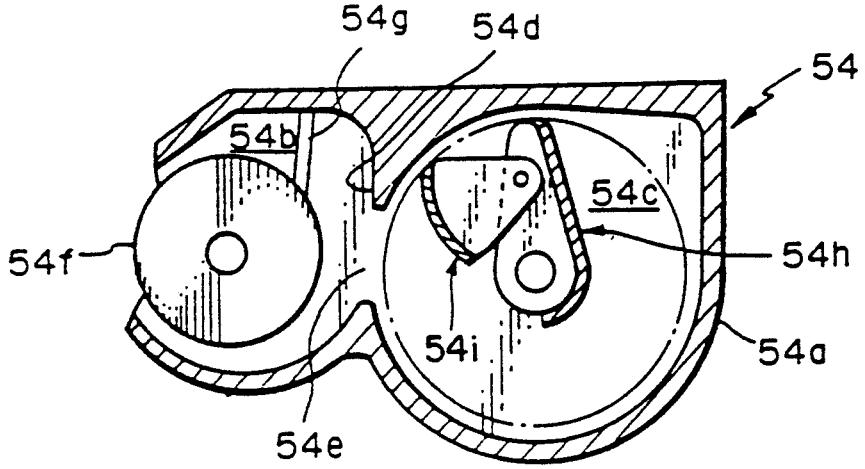

FIGS. 7(*a*) and 7(*b*) show a developing device for a non-magnetic type one-component developer, generally indicated by reference numeral 54, constructed according to the present invention. The developing device 54 is formed as an exchangeable unit, and is detachably incorporated in an electrophotographic printer. The developing device includes a vessel 54a, an interior of which is divided into two chambers 54b and 54c by a partition wall 54d integrally extended from the vessel 54a, and the chambers 54b and 54c are in communication with each other through an opening 54e formed in the partition wall 54d.

The developing device 54 also includes a developing roller 54f rotatably provided in the chamber 54b, and the developing roller 54f may be made of the same material as the developing roller 20b. A blade member 54g is also provided in the chamber 54b to be in engagement with the developing roller so that a thickness of a developer layer to be formed therearound is uniformly regulated. The chamber 54c holds a body of the developer herein.

The developing device 54 further includes a paddle blade member 54h rotatably provided in the developer chamber 54c, and a lid member 54i swingably pivoted thereto. The paddle blade member 54h and the lid member 54i are constructed in generally the same manner as the paddle blade member 22c and the lid member 22h shown in FIGS. 2 and 4, respectively. The lid member 54i is provided with an elastic seal element securely attached thereto, and the paddle blade member 54h is positioned at an angular position as shown in FIG. 7(*a*), so that the lid member 54i can function to close the opening 54e with the elastic seal element thereof, whereby prevention of leakage of the developer from the opening 54e can be ensured. When the paddle blade member 54h is rotated in a direction indicated by an arrow in FIG. 7(*a*), the lid member 54i is entrained by the rotating paddle blade member 54h, and is rotationally moved about the pivot thereof in the reverse direction, as shown in FIG. 7(*b*). Thus, the lid member 54i is moved from a closed position shown in FIG. 7(*a*), so that a seal for the developer chamber is broken. Namely, the two chambers 54b and 54c are in communication with each other, and thus the developer canned from the chamber 54c to the chamber 54b. In FIGS. 7(*a*) and 7(*b*), a surface of revolution described by the rotating paddle blade member 54h is shown by a chain-dot line, and the lid member 54i is encompassed by the surface of revolution after the rotation of the paddle blade member 54h, as shown in FIG. 7(*b*).

According to the embodiment as shown in FIGS. 7(*a*) and 7(*b*), no manual operation is necessary for breaking the seal for the developer chamber 54c of the developing device 54. Namely, only a setting by a user of the developer device is necessary before a proper operation of the printer can be obtained.

Finally, it will be understood by those skilled in the art that the foregoing description is of preferred embodiments of the present invention, and that various changes and modifications can be made without departing from the spirit and scope thereof.

I claim:

1. A cartridge type developer supplier detachably mounted in a developing device for an image formation apparatus, which comprises:

a container means for holding a supply of developer and having an outlet port formed therein for discharging the developer therethrough;

a paddle means rotatably provided in said container means for feeding a part of the developer from said container means to said developing device through said outlet port during rotation of said paddle means; and a lid means movably associated with said paddle means so that said lid means is enabled to take an initial position for closing said outlet port when said paddle means is positioned at a given angular position prior to commencement of rotation thereof, and wherein said lid means is moved from the initial position thereof after the commencement of the rotation of said paddle means so that said outlet port is opened to enable said container means to feed the developer to said developing device.

2. A cartridge type developer supplier as set forth in claim 1, wherein said lid means is entrained with said paddle means after the commencement of the rotation of said paddle means so as to be encompassed by a surface of revolution described by the rotating paddle means.

3. A cartridge type developer supplier as set forth in claim 1, wherein said lid means is pivoted to said paddle member to be swingable about an axis offset from a rotational axis of said paddle means and extended in parallel therewith.

4. A cartridge type developer supplier detachably mounted in a developing device for an image formation apparatus, which comprises:

a container means for holding a supply of developer and having an outlet port formed therein for discharging the developer therethrough;

a paddle means rotatably provided in said container means for feeding a part of the developer from said container means to said developing device through said outlet port during a rotation of said paddle means;

a lid means movably associated with said paddle means so that said lid means is enabled to take an initial position for closing said outlet port when said paddle means is positioned at a given angular position prior to a commencement of the rotation thereof; and a spring means for resiliently biasing said lid means so as to be moved from the initial position thereof, and wherein said paddle means is engageable with said lid means in such a manner that said lid means is forcibly moved to the initial position thereof against a resilient force of said spring means, and is disengageable from said lid means after the commencement of the rotation of said paddle means, whereby said lid means is resiliently moved from the initial position thereof so that said outlet port is opened to enable said container means to feed the developer to said developing device.

5. A cartridge type developer supplier as set forth in claim 4, wherein said lid means is entrained with said paddle means after the commencement of the rotation of said paddle means so as to be encompassed by a surface of revolution described by the rotating paddle means.

6. A cartridge type developer supplier as set forth in claim 4, wherein said lid means is movable toward and away from a rotational axis of said paddle means.

7. A developing device formed as an exchangeable unit and detachably incorporated in an image formation apparatus, which comprises:

a vessel means;

a partition wall means provided in said vessel means for dividing said vessel into first and second chambers communicating with each other through an opening formed in said partition wall;

a developing roller means rotatably provided in the first chamber of said vessel means;

a supply of developer held in the second chamber of said vessel means;

a paddle means rotatably provided in said second chamber for feeding a part of the developer from said second chamber to said first chamber through the opening of said partition means during a rotation of said paddle means; and a lid means movably associated with said paddle means so that said lid means is enabled to take an initial position for closing said opening when said paddle means is positioned at a given angular position prior to a commencement of the rotation thereof, and wherein said lid means is moved from the initial position thereof after the commencement of the rotation of said paddle means so that said opening is opened to enable said second chamber to feed the developer to said first chamber.

8. A developing device as set forth in claim 7, wherein said lid means is entrained with said paddle means after the commencement of the rotation of said paddle means so as to be encompassed by a surface of revolution described by the rotating paddle means.

9. A developing device as set forth in claim 7, wherein said lid means is pivoted to said paddle means to be swingable about an axis offset from a rotational axis of said paddle means and extended in parallel therewith.

10. An image formation apparatus comprising:

an electrostatic latent image carrying body means for carrying an electrostatic latent image formed thereon;

a developing device means for electrostatically developing the electrostatic latent image by a developer; and a cartridge type developer supplier means detachably mounted in said developing device means for supplying developer thereto, said cartridge type developer supplier means including:

a container means for holding a supply of developer and having an outlet port formed therein for discharging the developer therethrough;

a paddle means rotatably provided in said container means for feeding a part of the developer from said container means to said developing device through said outlet port during a rotation of said paddle means; and a lid means movably associated with said paddle means so that said lid means is enabled to take an initial position for closing said outlet port when said paddle means is positioned at a given angular position prior to a commencement of the rotation thereof, said lid means being moved from the initial position thereof after the commencement of the rotation of said paddle means so that said outlet port is opened to enable said container means to feed the developer to said developing device.

11. An image formation apparatus comprising:

an electrostatic latent image carrying body means for carrying an electrostatic latent image formed thereon;

a developing device means for electrostatically developing the electrostatic latent imáge by a developer; and a cartridge type developer supplier means detachably mounted in said developing device means for supplying developer thereto, said cartridge type developer supplier means including:

a container means for holding a supply of developer and having an outlet port formed therein for discharging the developer therethrough;

a paddle means rotatably provided in said container means for feeding a part of the developer from said container means to said developing device through said outlet port during a rotation of said paddle means;

a lid means movably associated with said paddle means so that said lid means is enabled to take an initial position for closing said outlet port when said paddle means is positioned at a given angular position prior to a commencement of the rotation thereof; and a spring means for resiliently biasing said lid means so as to be moved from the initial position thereof, and wherein said paddle means is engageable with said lid means in such a manner that said lid means is forcibly moved to the initial position thereof against a resilient force of said spring means, and is disengageable from said lid means after the commencement of the rotation of said paddle means, whereby said lid means is resiliently moved from the initial position thereof so that said outlet port is opened to enable said container means to feed the developer to said developing device.

12. An image formation apparatus comprising:

an electrostatic latent image carrying body means for carrying an electrostatic latent image formed thereon; and a developing device means for electrostatically developing the electrostatic latent image by a developer, said developing device means being detachably incorporated in the image formation apparatus, and including:

a vessel means for holding the developer therein;

a partition wall means provided in said vessel means for dividing said vessel into first and second chambers communicating with each other through an opening formed in said partition wall;

a developing roller means rotatably provided in the first chamber of said vessel means;

a supply of developer held in the second chamber of said vessel means;

a paddle means rotatably provided in said second chamber for feeding a part of the developer from said second chamber to said first chamber through the opening of said partition means during a rotation of said paddle means; and a lid means movably associated with said paddle means so that said lid means is enabled to take an initial position for closing said opening when said paddle means is positioned at a given angular position prior to a commencement of the rotation thereof, said lid means being moved from the initial position thereof after the commencement of the rotation of said paddle means so that said opening is opened to enable said second chamber to feed the developer to said first chamber.

* * * * *

UNITED STATES PATENT AND TRADEMARK OFFICE

CERTIFICATE OF CORRECTION

PATENT NO. : 5,325,163

DATED : June 28, 1994

INVENTOR(S) : Yukio Nishio

It is certified that error appears in the above-indentified patent and that said Letters Patent is hereby corrected as shown below:

Column 6, line 66, change "indirections" to --in directions --.

Column 11, line 7, change "canned" to --can be fed--.

Signed and Sealed this

Twenty-seventh Day of September, 1994

*Attest:*

Bruce Lehman

BRUCE LEHMAN

*Attesting Officer*

*Commissioner of Patents and Trademarks*